US006336324B1

(12) United States Patent
Schniederjan et al.

(10) Patent No.: US 6,336,324 B1
(45) Date of Patent: Jan. 8, 2002

(54) SLEWING GEAR CONTROL SYSTEM WITH BRAKING AND CONTROL VALVES

(75) Inventors: Reinhold Schniederjan, Neu-Ulm; Bernhard Adler, Elchingen, both of (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/485,608

(22) PCT Filed: Jul. 24, 1998

(86) PCT No.: PCT/EP98/04647

§ 371 Date: May 25, 2000

§ 102(e) Date: May 25, 2000

(87) PCT Pub. No.: WO99/09320

PCT Pub. Date: Feb. 25, 1999

(30) Foreign Application Priority Data

Aug. 13, 1997 (DE) ..... 197 35 111

(51) Int. Cl.[7] ..... F16D 31/02
(52) U.S. Cl. ..... 60/444; 60/476
(58) Field of Search ..... 60/443, 444, 452, 60/473, 476

(56) References Cited

U.S. PATENT DOCUMENTS 4,554,991 A * 11/1985 Eden ..... 60/444
4,571,941 A * 2/1986 Aoyagi ..... 60/444
6,082,107 A * 7/2000 Schniederjan ..... 60/444
6,167,702 B1 * 1/2001 Schniederjan ..... 60/444

FOREIGN PATENT DOCUMENTS

| | | |
|---|---|---|
| DE | 195 03 943 A1 | 9/1995 |
| DE | 196 20 664 C1 | 6/1997 |
| DE | 196 20 665 C1 | 6/1997 |
| WO | WO 97/44536 | 11/1997 |
| WO | PCT/EP98/04647 | 7/1998 |

* cited by examiner

*Primary Examiner*—Edward K. Look
*Assistant Examiner*—Igor Kershteyn
(74) *Attorney, Agent, or Firm*—Scully, Scott, Murphy & Presser

(57) ABSTRACT

A control circuit, in particular for a slewing gear of a digger, has a hydraulic fluid tank (21), connected to two adjusting pressure chambers (10, 11). Each of the connections contains a separate brake valve (19, 20). The first of the valves (19) is operated by the differential between the working pressure in the first working conduit (2), and the control pressure in the control conduit (33, 34) charged with the higher pressure. The second valve (20) is operated by the differential between the working pressure in the second working circuit (3) and the control pressure in the control circuit charged with the higher pressure. Slow braking by the brake valves is interrupted when the slewing gear swings out against a resistance such as a heap of debris.

12 Claims, 3 Drawing Sheets

SLEWING GEAR CONTROL SYSTEM WITH BRAKING AND CONTROL VALVES

FIELD OF THE INVENTION

The invention relates to a hydraulic control system, in particular for activating a slewing gear of a digger.

A hydraulic control system is known from DE 196 20 664 C1. In the slewing gear control system disclosed by said publication, an adjusting apparatus is provided for adjusting an actuating piston, which is disposed between two actuating pressure chambers and influences the displacement volume of a hydraulic pump. The adjustment of the actuating piston is effected in dependence upon the pressure difference between two actuating pressure lines, which are connected each to one of the actuating pressure chambers. The actuating pressure in the actuating pressure lines is predetermined by two control lines connected to a manual control transmitter. Provided in each actuating pressure line is a separate braking valve, which throttles the return flow of hydraulic fluid from the actuating pressure chamber associated with the braking valve into a hydraulic fluid tank and hence enables the slewing gear to swing slowly outwards after the manual control transmitter has been returned into its neutral position by the operator. The effect achieved by the use of two separate braking valves, which are each connected to one of the working lines which connect a hydraulic motor driving the slewing gear to the hydraulic pump so as to form a working circuit, is that the slow braking by the braking valves is interrupted when the stewing gear swings out against a resistance, e.g. a heap of debris.

A drawback of the known hydraulic control system is however that the braking valves are disposed in the actuating pressure lines and are therefore biased by the actuating pressure. During the excursion of the actuating piston for accelerating the slewing gear, the hydraulic fluid filling the appropriate actuating chamber therefore flows through the braking valves, which are therefore exposed to increased fouling. The discharge of hydraulic fluid to the hydraulic fluid tank is effected by means of the manual control transmitter over relatively long line paths. Thus, the return flow of hydraulic fluid is restricted not only by the throttle provided in the braking valve but also by the area of the control lines and the opening area of the manual control transmitter. As a result, the time constant for the return flow of hydraulic fluid from the actuating pressure chambers of the adjusting apparatus may be adjusted reproducibly only to a limited extent by the throttle area of the braking valves. In said case, it has to be taken into account that the line length of the control lines, the manual control transmitter used and further structural parameters vary depending on the type of digger in which the hydraulic slewing gear control system is to be installed. The throttle area of the braking valves therefore has to be individually adapted to each type of digger, which entails a high assembly outlay. In addition, because the throttle areas of the braking valves used in DE 196 20 664 C1 are not adjustable, an adjustment after installation is not easily possible.

A further slewing gear control system is disclosed by DE 196 20 665 C1. In said slewing gear control system, the actuating pressure for the actuating pressure chambers of the adjusting apparatus is derived from the supply pressure of a supply apparatus via one or two pressure control valves. In said case, only one common braking valve for both actuating pressure chambers is provided, which is disposed in return flow direction downstream of a pilot device or pilot valve.

In said refinement also, the return flow of hydraulic fluid first passes through the pilot valve, which likewise throttles the return flow, before reaching the braking valve. The effective throttle area therefore depends not only upon the throttle area of the braking valve but also upon the throttle area of the pilot valve as well as the areas of the connecting lines. The adjustment of the effective throttle area for the return flow of hydraulic fluid and hence the adjustment of the braking of the slewing gear is therefore made more difficult with said construction of the slewing gear control system also, especially as a variable, adjustable throttle area for the braking valve is not provided.

The object of the invention is therefore to indicate a hydraulic control system, in particular for activating the slewing gear of a digger, whereby the throttle area for the return flow of hydraulic fluid through the braking valves is definable more precisely and fouling of the braking valves is moreover counteracted.

SUMMARY OF THE INVENTION

The invention is based on the discovery that it is advantageous to dispose the braking valves, without interposing further valves, directly between the actuating pressure chambers of the adjusting apparatus and the hydraulic fluid tank. The resultant effect is short line paths for the return flow of hydraulic fluid from the actuating pressure chambers to the hydraulic fluid tank via the braking valve so that the effective throttle area depends substantially upon the throttle area defined by the braking valve and only to an insignificant extent upon the line areas. In the return flow path, apart from the braking valve, no further valves effecting an additional throttling are provided. By virtue of the fact that only the return flow of hydraulic fluid passes through the braking valves but not the flow of hydraulic fluid into the actuating pressure chambers in the event of acceleration of the slewing gear, the fouling of the braking valves is markedly reduced. In order, in the event of swinging-out of the hydraulic pump and loading of the actuating pressure lines with actuating pressure, to prevent a hydraulic short circuit of the actuating pressure lines via the braking valves towards the hydraulic fluid tank and, on the other hand, prevent a reflux of the returning hydraulic fluid into the actuating pressure lines or control lines, in each case a control valve is disposed in return flow direction downstream of a branch leading to the respective braking valve. According to the invention, the control valves and the braking valves are activated in such a way by the control pressure prevailing in the control lines that in the event of swinging-out of the hydraulic pump the control valves open and the braking valves close and, conversely, the control valves close and the braking valves open into their throttled valve position when the hydraulic fluid flows from the actuating pressure chambers back to the hydraulic fluid tank.

It is advantageous to provide the throttle area of the braking valves in an adjustable manner. This becomes possible only by virtue of the solution according to the invention, namely the arrangement of the braking valves not in the actuating pressure lines but in secondary lines, which branch off to the pressure medium tank, are biased with a lower pressure and exposed to less fouling. The braking valves in the known hydraulic control system take the form of seat valves so that they can withstand the actuating pressure there and be less susceptible to fouling. With seat valves, the construction of an adjustable throttle area is impossible or possible only with difficulty. An adjustable throttle area can be constructed more easily with a slide valve. A slide valve cannot however be used in the known hydraulic control system because, in the event of fouling, it can jam and hence lead to serious malfunctions. Given the development according to the invention, the use of a slide valve in the secondary line leading to the hydraulic fluid tank is however possible. In said case, the braking valve can comprise a braking valve piston, which is movable in a braking valve housing, cooperates with a control edge of the braking valve housing and has a bevel. The braking valve piston can strike against an adjustable stop which defines the throttle area of the braking valve, which throttle area is fixed by the overlap of the bevel of the braking valve piston with the control edge of the braking valve housing. In said case, the braking valve can comprise a braking valve spring which biases the braking valve piston towards the stop.

The control valve can take the form of seat valves and each comprise a control valve piston, which is movable in each case in a control valve housing. In said case, the control valve piston can have a conical portion, which cooperates with a valve seat so as to form a sealed seat. It is advantageous for the control valves to taken the form of seat valves because they then present a relatively high pressure resistance and insensitivity to fouling. Each control valve can comprise a control valve spring, which pressure the control valve piston against the valve seat. The control valve piston preferably takes the form of a stepped piston, wherein a step of the control valve piston is biased by the activating control pressure, thereby producing a hydraulically activated seat valve.

The braking valves and the control valves can be connected by a pressure change valve to the control lines. A supply device can be provided, which generates a supply pressure in a supply line. The actuating pressure can be connected in each case by an associated pressure control valve to the supply line, wherein the actuating pressure in the actuating pressure lines is adjusted by means of the control pressure prevailing in the control lines. When a pressure control valve spring is provided, which sets the actuating pressure slightly higher than the activating control pressure, then even given an imperceptible control pressure, there is a slight actuating pressure available, which is used to top up the actuating pressure chamber which increases in volume when the hydraulic pump swings back. A top-up device with a relatively large filter is therefore not required.

The control lines can be alternately loadable with control pressure by means of a control transmitter, which is connected to a control pressure supply and the hydraulic fluid tank.

BRIEF DESCRIPTION OF THE DRAWINGS

There now follows a description of preferred embodiments with reference to the drawings. The drawings show.

DETAILED DESCRIPTION OF PREFERRED EMBODIMENTS

Figure 1:
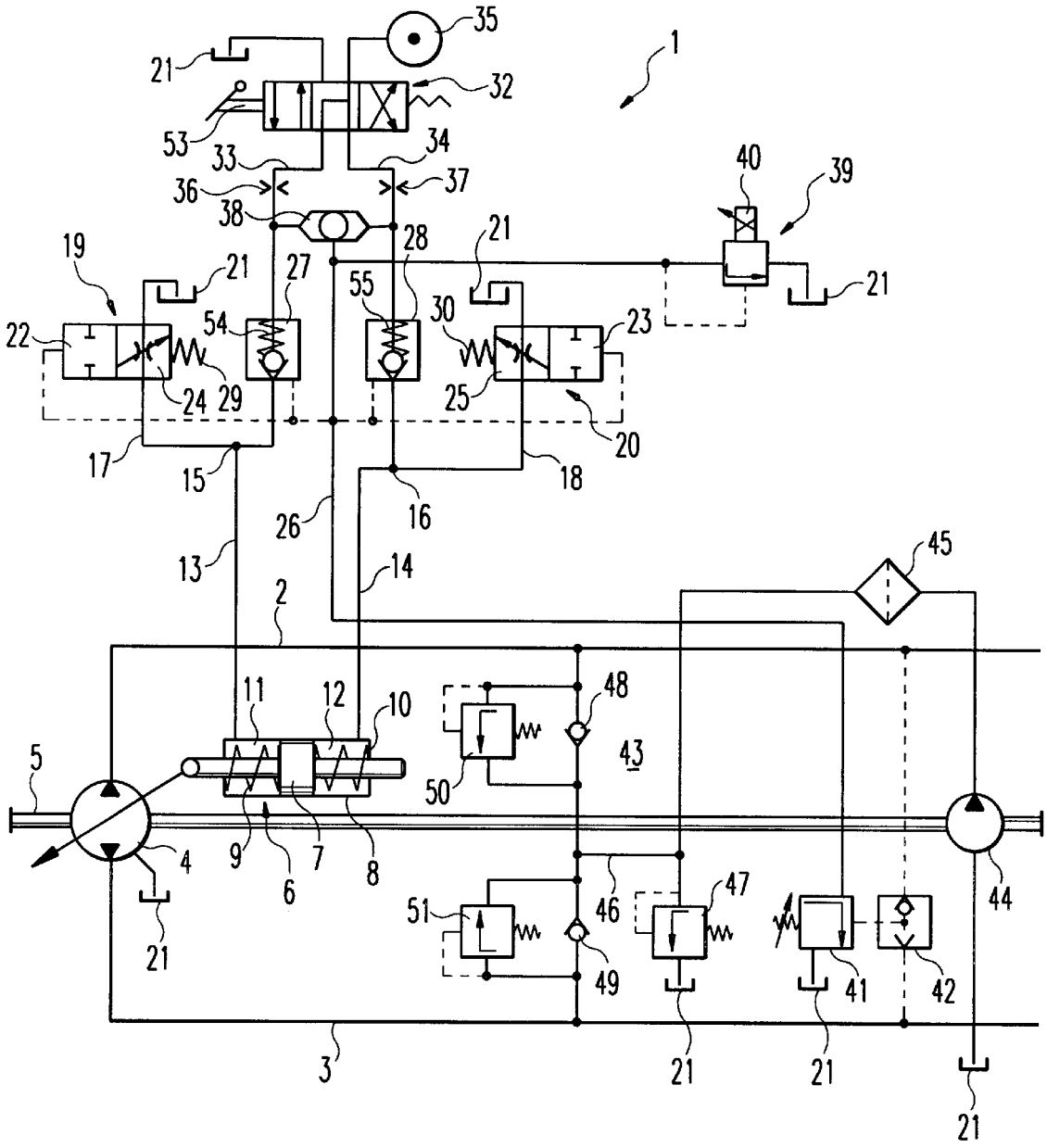
FIG. 1 a hydraulic block diagram of a first embodiment of the hydraulic control system according to the invention.

FIG. 1 shows a first embodiment of the hydraulic control system according to the invention. The hydraulic control system denoted generally by the reference character 1 is used in particular to activate the slewing gear of a digger. The slewing gear of the digger is in said case driven by a hydraulic motor (not shown), which is connected by a first working line 2 and a second working line 3 to the hydraulic pump 4 so as to form a working circuit. The hydraulic pump 4, e.g. for an i.c. engine (not shown), is driven via the drive shaft 5. The delivery direction of the hydraulic pump is reversible so that, depending on the desired direction of rotation of the slewing gear, either the working line 2 or the working line 3 operates as a high-pressure line.

The displacement volume of the hydraulic pump 4 is adjustable by means of an adjusting apparatus 6. The adjusting apparatus 6 comprises an actuating piston 7, which is movable in an actuating cylinder 8 and is centered without pressurization in its neutral position with zero displacement volume, which is shown in FIG. 1, by means of two centering springs 9 and 10. The actuating piston 7 divides the actuating cylinder 8 into a first actuating pressure chamber 11 and a second actuating pressure chamber 12. The first actuating pressure chamber 11 is connected to a first actuating pressure line 13, while the second actuating pressure chamber 12 is connected to a second actuating pressure line 14, which lines supply the actuating pressure to the actuating pressure chambers 11,12.

According to the invention, a branch 15, 16 is provided in each of the actuating pressure lines 13, 14. A secondary line 17, 18 branches off towards each braking valve 19, 20 so that the first actuating pressure chamber 11 is connected by the braking valve 19 to the hydraulic fluid tank 21 and the second actuating pressure chamber 12 is connected by the braking valve 20 to the hydraulic fluid tank 21. The braking valve 19, 20 has a closed valve position 22, 23, in which the flow through the respective braking valve 19, 20 is interrupted, and a throttled valve position 24, 25, in which the flow through the respective braking valve 19, 20 is throttled. The throttle area, which the braking valve 19, 20 has in its throttled valve position 24, 25, is preferably adjustable. The braking valves 19 and 20 are activated by a common control pressure line 26 in such a way that, when the control pressure in the control pressure line 26 drops below a defined threshold value, they change or switch over into their throttled valve position 24 and 25 respectively. When the control pressure in the control pressure line 26 exceeds the defined threshold value, the braking valves 19 and 20 are situated in their closed valve position 22 and 23 respectively and are blocked. When however the control pressure in the control pressure line 26 is greater than the defined threshold value, the braking valves 19 and 20 are pressed into their throttled valve position 24 and 25 respectively so that the braking valves 19 and 20 have a throttled, preferably adjustable throughflow. The threshold value is preferably preset to a very low, almost or totally imperceptible control pressure and is adjustable by means of the braking valve springs 29 and 30.

Situated in each of the actuating pressure lines 13 and 14 is a control valve 27 and 28 respectively. Said control valves 27 and 28 are disposed in such a way that the branches 15 and 16 are situated in each case between the control valves 27 and 28 and the actuating pressure chambers 11 and 12 of the adjusting apparatus 6. The braking valves 19 and 20 are therefore connected by the branches 15 and 16 directly to their associated actuating pressure chamber 11 and 12 respectively without any further hydraulic valves, besides the braking valves 19 and 20, being situated along the hydraulic line path between the actuating pressure chambers 11 and 12 and the hydraulic fluid tank 21. The braking valves 19 and 20 are preferably disposed in the immediate spatial vicinity of the actuating pressure chambers 11 and 12, using only short line paths for the line portion of the actuating pressure line 13, 14 to the branch 15, 16 and for the secondary line 17, 18.

The control valves 27 and 28 are activated likewise by the control pressure prevailing in the control pressure line 26. In said case, the control valves 27 and 28 open when the control pressure in the control pressure line 26 exceeds a defined threshold value. Conversely, the control valves 27 and 28 close when the control pressure in the control pressure line 26 drops below the defined threshold value. The control valves 27 and 28 preferably take the form of seat valves, e.g. check valves, while the braking valves 19 and 20 preferably take the form of slide valves.

In the illustrated embodiment, the actuating pressure in the actuating pressure lines 13 and 14 and hence the deflection of the hydraulic pump 4 is defined by means of a manual control transmitter 32, which connects two control lines 33 and 34 either to a control pressure supply 35 or to the hydraulic fluid tank 21 depending on the desired direction of rotation of the slewing gear. Depending on the intended direction of rotation of the slewing gear, either the control line 33 or the control line 34 is loaded with control pressure. In the embodiment, the control lines 33 and 34 are directly connected by throttle points 36 and 37 to the control valves 27 and 28. In the embodiment illustrated in FIG. 1, the actuating pressure prevailing in the actuating pressure lines 13 and 14 is therefore derived directly from the control pressures prevailing in the control lines 33 and 34. Said embodiment dispenses with pilot control and is suitable particularly for slewing gear control systems of a small nominal size.

The control lines 33 and 34 are connected to the control pressure line 26 by a pressure change valve 38, which in each case selects the highest of the control pressures prevailing in the two control lines 33 and 34. In each case, the highest of the control pressures prevailing in the control lines 33 and 34 therefore prevails in the control pressure line 26. The control pressure line 26 is connected by a pressure cut-off valve 39 to the hydraulic fluid tank 21. The pressure cut-off valve 39 takes the form of a pressure relief valve and limits the pressure in the control pressure line 26 to a maximum pressure defined by means of an electrical transmitter 40. The control pressure line 26 is connected to the hydraulic fluid tank 21 by a further pressure relief valve 41, which is activated via a pressure change valve 42 by the, in each case, highest working pressure prevailing in the working lines 2 and 3 and enables working pressure-dependent pressure relief.

A supply device 43 is further provided. The supply device 43 comprises a supply pump 44, which is connected by the common shaft 5 to the hydraulic pump 4 and via a supply filter 45 supplies a supply pressure limited by the pressure relief valve 47 into a supply line 46. The supply pressure is introduced via a check valve 48 or 49 into the respective working line 2 or 3 carrying the low pressure. The maximum working pressure in the working lines 2 and 3 is limited by the pressure relief valves 50 and 51.

The hydraulic control system according to the invention operates in the following way.

To accelerate the slewing gear driven by the hydraulic motor (not shown), the hydraulic pump 4 connected to the hydraulic motor is swung out by operating the joy-stick 53 of the control transmitter 32. Depending on the intended direction of rotation of the slewing gear, either the control line 33 or the control line 34 is loaded via the control pressure supply 35 with a proportioned control pressure, while the other control line 34 or 33 is connected to the hydraulic fluid tank 21. The control pressure building up in the control line 33 or prevails also in the control pressure line 26 and effects an opening of the control valves 27 and 28. In the embodiment illustrated in FIG. 1, the actuating pressure lines 13 and 14 are therefore connected by the control valves 27 and 28 directly from the control lines 33 and 34, so that the actuating pressure in the illustrated embodiment is derived directly to the control pressure. As a result, one of the two actuating pressure chambers 11 or 12 is loaded with actuating pressure and the other actuating pressure chamber 12 or 11 is relieved via the respective control valve 27 or 28 and the control transmitter 32 towards the hydraulic fluid tank 21. The actuating piston 7 of the adjusting apparatus 6 is accordingly displaced and the hydraulic pump 4 is swung out in the intended direction. The braking valves 19 and 21 are biased by the control pressure in the control pressure line 26 in such a way that they are situated in their closed valve position 22 and 23 and so via the braking valves 19 and 20 no pressure losses arise in the actuating pressure lines 13 and 14.

As soon as the slewing gear has reached the desired rotational speed, the operator may let go of the joy-stick 53 with the result that the control transmitter 32 is returned into its neutral position, in which it connects the control lines 33 and 34 to the hydraulic fluid tank 21. Thus, control pressure no longer prevails in the control lines 33 and 34 and the common control pressure line 26 also no longer carries control pressure. Consequently, the control valves 27 and 28 are closed by the control valve spring 54 and 55, while the braking valves 19 and 20 are switched by their braking valve springs 29 and 30 into their throttled valve position 24 and 25. The hydraulic pump 4 is still situated in its swung-out delivery position with the actuating piston 7 displaced out of the neutral position. The centring springs 9 and 10 gradually return the actuating piston 7 into its neutral position shown in FIG. 1, wherein the time constant required for said purpose depends upon the throttling effected by the braking valves 19 and 20. Since the throttling of the return flow of hydraulic fluid from the actuating pressure chambers 11 and 12 to the hydraulic fluid tank 21 is determined almost exclusively by the throttle area of the respective braking valve 19 or 20, said time constant may be adjusted very precisely and reproducibly. Since the throttle area of the braking valves 19 and 20 is preferably designed so as to be variable, a suitable fine tuning may be effected. According to the invention, the braking valves 19 and 20 are connected directly, without interposing further valves or longer hydraulic lines, to the actuating pressure chambers 11 and 12 with the result that the effective throttling of the return flow is determined solely by the braking valves 19 and 20. A reflux of hydraulic fluid into the control lines 33 and 34 is ruled out because the control valves 27 and 28 block in said operating situation.

The threshold value for the switchover between the valve positions of the braking valves 19 and 20 and the control valves 27 and 28 is adjustable by means of the braking valve springs 29 and 30 and the control valve springs 54 and 55 respectively.

Figure 2:
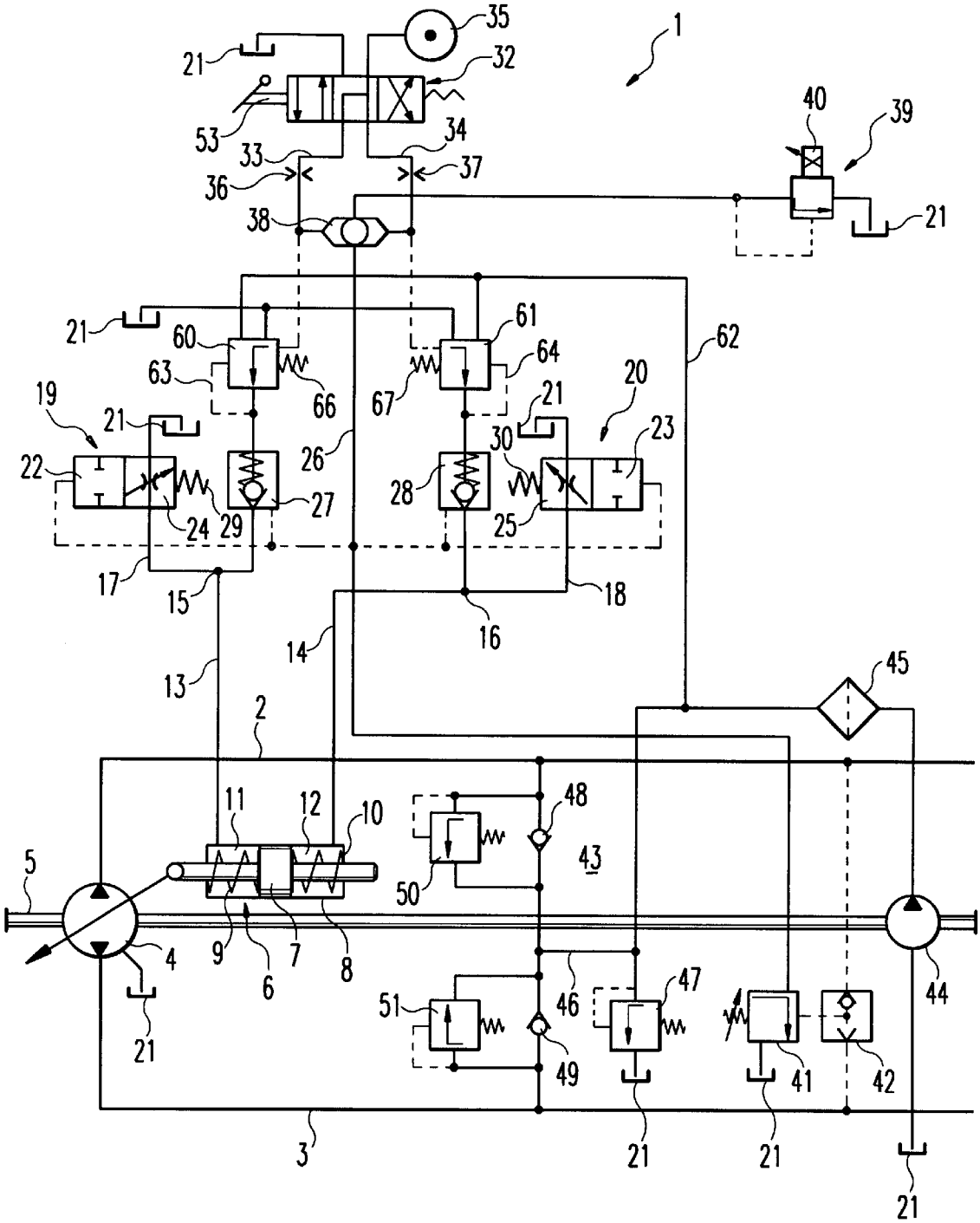
FIG. 2 a hydraulic block diagram of a second embodiment of the hydraulic control system according to the invention.

FIG. 2 shows a second embodiment of the hydraulic control system according to the invention. Elements already described with reference to FIG. 1 are provided with matching reference characters so that, in said respect, a repeat description is unnecessary.

The embodiment shown in FIG. 2 differs from the embodiment already described with reference to FIG. 1 in that two pressure control valves 60 and 61 are provided, which at their outputs are connected to the actuating pressure lines 13 and 14 in each case upstream of the control valves 27 and 28. A respective one of the inputs of the pressure control valves 60 and 61 is connected to the hydraulic fluid tank 21, while a respective other input of the pressure control valves 60 and 61 is connected by a connecting line 62 in each case to the supply line 46. Each pressure control valve 60 or 61 is connected at a first control input to an associated control line 33 or 34 and at a second control input to the actuating pressure line 13 or 14 by a detour line 63 or 64. Each pressure control valve 60 or 61 is therefore activated by a pressure difference between the control pressure in the associated control line 33 or 34 and the actuating pressure in the associated actuating pressure line 13 or 14. As a result, the actuating pressure in the actuating pressure line 13 or 14 substantially corresponds to the control pressure in the associated control line 33 or 34.

Since the pressure control valves 60 and 61 are in addition biased slightly in the opening direction by a pressure control valve spring 66 and 67 respectively, the actuating pressure prevailing in the actuating pressure line 13 or 14 is slightly, e.g. 1 to 2 bar, higher than the control pressure in the associated control line 33 or 34. In the actuating pressure line a slight pressure therefore prevails even when there is no control pressure in the associated control line 33 or 34. During the return of the actuating piston 7 into its neutral position defined by the centering springs 9 and 10, hydraulic fluid may therefore continue to flow via the supply device 43, the connecting line 62 and the associated pressure control valve 60 or 61 as well as the associated control valve 27 or 28 into the actuating pressure chamber 11 or 12 which increases in volume during the return of the actuating piston 7 into the neutral position. A top-up device with a correspondingly large top-up filter is therefore not required.

By virtue of the reduction of the control pressure-dependent actuating pressure effected by means of the pressure control valves 60 and 61, the embodiment shown in FIG. 2 is also suitable for hydraulic control systems of a large nominal size, i.e. for large-dimension slewing gear control systems.

Figure 3:
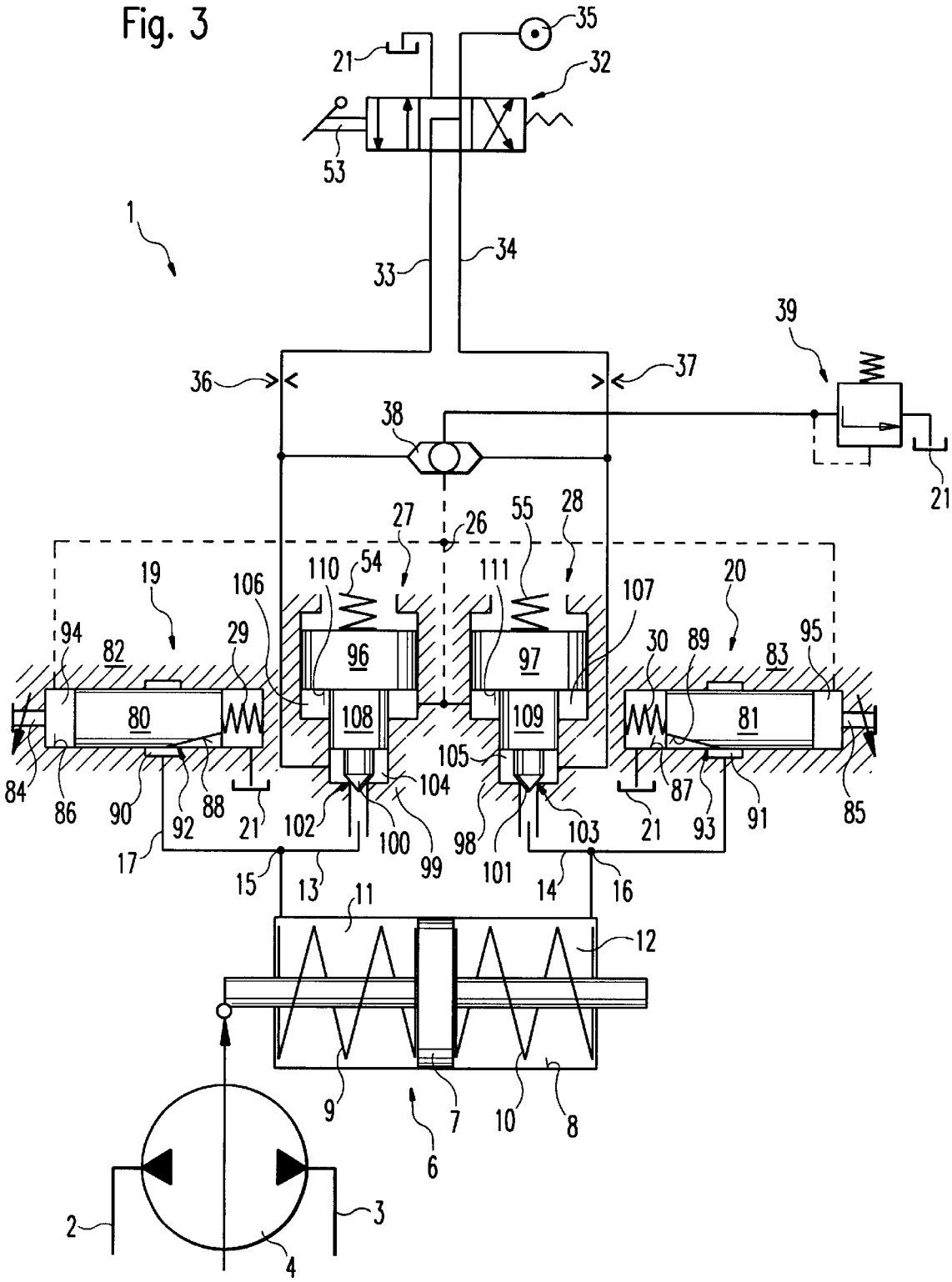
FIG. 3 a diagrammatic constructional realization of the embodiment shown in FIG. 1.

FIG. 3 shows a diagrammatic view of an exemplary constructional refinement of the braking valves 19 and 20 and the control valves 27 and 28. To make it easier to understand, the hydraulic circuit in accordance with FIG. 1 is likewise indicated. Elements already described with reference to FIG. 1 are provided with matching reference characters so that, in said respect, a repeat description is unnecessary.

In the preferred embodiment shown in FIG. 3, the braking valves 19 and 20 take the form of slide valves. Braking valve pistons 80 and 81 are in each case disposed in an axially movable manner in a braking valve housing 82 or 83 and biased by means of the braking valve spring 29 or 30 towards a preferably adjustable stop 84 or 85. The stop 84 or 85 projects axially in a cylinder bore 86 or 87 formed in the respective braking valve housing 82 or 83. The extent of axial projection may be adjusted, for example, in that the stop 84 or 85 has a thread which may be screwed into the braking valve housing 82 or 83. The position of the stops 84 and 85 may alternatively be adjustable by means of an e.g. electromagnetic or hydraulic transmitter by the operator of the digger so that the slow, gentle outward swing of the slewing gear may be flexibly adjusted by varying the throttle area of the braking valves 19 and 20 by means of the stops 84 and 85.

The braking valve piston 80 or 81 has a bevel 88 or 89 and cooperates with a control edge 92 or 93 formed on an annular groove 90 or 91. The control pressure line 26 leads to a pressure chamber 94 or 95, to which the braking valve piston 80 or 81 is adjacent. As the pressure in the control pressure line 26 increases, the braking valve piston 80 or 81 is therefore displaced towards the braking valve spring 29 or 30 and the control edge 92 or 93 is sealed by the non-bevelled region of the braking valve piston 80 or 81. As the pressure in the control pressure line 26 decreases, the braking valve piston 80 or 81 is retracted in FIG. 3 to the left or right by the braking valve spring 29 or 30 so that the bevel 88 or 89 progressively releases the control edge 92 or 93. The throttle opening of the braking valve 19 or 20 in the position of abutment against the stop 84 or 85 is fixed by the position of the stop 84 or 85 and is adjustable by varying the position of the stop 84 or 85.

In the preferred embodiment shown in FIG. 3, the control valves 27 and 28 take the form of seat valves. The control valve pistons 96 and 97 are movable in each case in a control valve housing 98 or 99. The control valve pistons 96 and 97 each have a conical portion 100 or 101. The control valve pistons 96 and 97 are each biased by a control valve spring 54 and 55 in such a way that the conical portion 100 or 101 is pressed against the valve seat 102 or 103 so as to produce a sealed seat. Formed upstream of the conical portion 100 or 101 is a first valve chamber 104 or 105, which is connected to the valve input. In the embodiment shown in FIG. 3, the valve input is connected directly to the associated control line 33 or 34. The valve output is connected to the associated actuating pressure line 13 or 14. In each case, a second valve chamber 106 or 107 is isolated from the first valve chamber 104 or 105 by a sealing step 108 or 109 of the control valve piston 96 or 97 and connected to the control pressure line 26. The control pressure prevailing in the control pressure line 26 acts upon a surface 110 or 111 of the control valve piston 96 or 97 and displaces the control valve piston 96 or 97 towards the control valve spring 54 or 55. When threshold valve defined by the control valve spring 54 55 is exceeded, the conical portion 100 or 101 lifts off the valve seat 102 or 103 and enables the flow through the control valve 27 or 28.

The braking valves 19 and 20 and the seat valves 27 and 28 may alternatively be designed in a different manner. In particular, it is possible for the control valves 27 and 28 to be alternatively designed as simple check valves, which prevent a reflux of hydraulic fluid into the control line 33 and 34 and/or into the pressure control valves 60 and 61.

What is claimed is:

1. Hydraulic control system (1) comprising an adjusting apparatus (6) for adjusting an actuating piston (7), which is disposed between two actuating pressure chambers (11, 12) and influences the displacement volume of a hydraulic pump (4), depending upon a pressure difference between two actuating pressure lines (13, 14) which are each connected to one of the actuating pressure chambers (11, 12), wherein the actuating pressure prevailing in the actuating pressure lines (13, 14) is defined by two control lines (33, 34), and one braking valve (19, 20) associated with each of the actuating pressure chambers (11, 12) and throttling return flow of hydraulic fluid from the associated actuating pressure chamber (11, 12) into a hydraulic fluid tank (21), characterized in that disposed in each actuating pressure line (13, 14) is a control valve (27, 28), which is switchable between an open and a closed valve position, that a branch (15, 16) is provided in each actuating pressure line (13, 14) between the associated control valve (27, 28) and the associated actuating pressure chamber (11, 12), wherein the associated braking valve (19, 20) is disposed between the branch (15, 16) and the hydraulic fluid tank (21) and switchable between a throttled valve position (24, 25) and a closed valve position (22, 23), and that the braking valves (19, 20) and the control valves (27, 28) are activated by the control lines (33, 34), wherein the braking valves (19, 20) are closed and the control valves (27, 28) are opened when the greater of the control pressures prevailing in the control lines (33, 34) is greater than a defined threshold value and the braking valves (19, 20) assume their throttled valve position (24, 25) and the control valves (27, 28) are closed when the greater of the control pressures prevailing in the control lines (33, 34) is lower than the defined threshold valve.

2. Hydraulic control system according to claim 1, characterized in that in each case a throttle area, which each braking valve (19, 20) assumes in its throttled valve position (24, 25), is adjustable.

3. Hydraulic control system according to claim 2, characterized in that the braking valves (19, 20) take the form of slide valves and comprise a braking valve piston (80, 81), which is movable in a braking valve housing (82, 83) and cooperates with a control edge (92, 93) of the braking valve housing (82, 83) and has a bevel (88, 89).

4. Hydraulic control system according to claim 3, characterized in that the braking valve piston (80, 81) strikes against an adjustable stop (84, 85), which defines the throttle area which the bevel (88, 89) of the braking valve piston (80, 81) releases at the control edge (92, 93) when the braking valve (19, 20) assumes its throttled valve position (24, 25).

5. Hydraulic control system according to claim 4, characterized in that each braking valve (19, 20) comprises a braking valve spring (39, 30), which biases the braking valve piston (80, 81) towards the stop (84, 85).

6. Hydraulic control system according to claim 1 characterized in that the control valves (27, 28) take the form of seat valves and each comprise a control valve piston (96, 97), which is movable in each case in a control valve housing (98, 99), wherein the control valve piston (96, 97) has a conical portion (100, 101), which cooperates with a valve seat (102, 103) so as to form a sealed seat.

7. Hydraulic control system according to claim 6, characterized in that each control valve (27, 28) comprises a control valve spring (54, 55), which loads the control valve piston (96, 97) towards the valve seat (102, 103).

8. Hydraulic control system according to claim 6 characterized in that the control valve piston (96, 97) takes the form of a stepped piston and a step of the control valve piston (96, 97) is loaded by the activating control pressure.

9. Hydraulic control system according to claim 1, characterized in that the braking valves (19, 20) and the control valves (27, 28) are connected by a pressure change valve (38) to the control lines (33, 34).

10. Hydraulic control system according to claim 1, characterized in that a supply device (43) is provided, which supplies a supply pressure in a supply line (46), that the actuating pressure lines (13, 14) are connected in each case by an associated pressure control valve (60, 61) to the supply line (46), and that each pressure control valve (60, 61) is loaded in each case by the pressure difference between the control pressure prevailing in one of the control lines (33, 34) and the actuating pressure prevailing in the associated actuating pressure line (13, 14).

11. Hydraulic control system according to claim 10, characterized in that each pressure control valve (60, 61) is additionally loaded by a pressure control valve spring (66, 67) in such a way that the actuating pressure prevailing in the associated actuating pressure line (13, 14) is slightly higher than the control pressure prevailing in the associated control pressure line (33, 34).

12. Hydraulic control system according to claim 1 characterized in that the control lines (33, 34) are either loadable with control pressure or relievable towards the hydraulic fluid tank (21) by means of a control transmitter (32), which is connected to the hydraulic fluid tank (21) and a control pressure supply (35).

* * * * *